US005222819A

United States Patent [19]

Tsukuda et al.

[11] Patent Number: 5,222,819

[45] Date of Patent: Jun. 29, 1993

[54] BRAILLE PRINTER

[75] Inventors: Yoshimi Tsukuda, Chofu; Isamu Goto, Musashino, both of Japan

[73] Assignee: Toyo Hybrid Co., Ltd., Mitaka, Japan

[21] Appl. No.: 860,086

[22] Filed: Mar. 30, 1992

[30] Foreign Application Priority Data

May 10, 1991 [JP] Japan ..... 3-041766[U]

[51] Int. Cl.[5] ..... B41J 2/23

[52] U.S. Cl. ..... 400/122; 400/131

[58] Field of Search ..... 400/127, 129, 130, 131, 400/122, 121, 132, 134.2

[56] References Cited

U.S. PATENT DOCUMENTS

| | | | |
|---|---|---|---|
| 3,726,380 | 4/1973 | Beer et al. | 400/131 |
| 3,901,369 | 8/1975 | Tsukamoto et al. | 400/131 |
| 4,183,683 | 1/1980 | Hiratsuka et al. | 400/122 |
| 4,261,663 | 4/1981 | Grimnes | 400/131 |
| 4,397,573 | 8/1983 | Thiel | 400/122 |

FOREIGN PATENT DOCUMENTS 56-98187 7/1981 Japan .

*Primary Examiner*—Edgar S. Burr
*Assistant Examiner*—John S. Hilten
*Attorney, Agent, or Firm*—Hoffmann & Baron

[57] ABSTRACT

A braille printer that embosses braille characters line by line, in which embossing dies formed in the form of a line on which a plurality of projections or recesses for embossing braille characters, and debossing dies, on which a plurality of projections or recesses are formed in a line, are made to face each other, and the recesses and projections at positions corresponding to printing signals are pressed against each other. Cams for making the embossing dies move forward are disposed at both end positions of a line of characters below each of the embossing dies which are held at embossing positions in such a manner as to be movable forward or backward. The contour of each of these cams at both end positions of the line of characters have an apex, each of these apices being the same distance from a cam shaft. The apex of one of the cams is formed to be continuous over a predetermined rotational angle, and the apex of the other cam is formed so as to have a phase difference relative to the starting point of the range of the predetermined rotational angle.

3 Claims, 2 Drawing Sheets

BRAILLE PRINTER

BACKGROUND OF THE INVENTION

1. Field of the Invention

The present invention relates to a braille printer that embosses braille characters line by line by a method wherein projections and recesses of embossing and debossing dies are engaged and pressed in response to braille signals in a state in which paper is placed between the projections and recesses thereof.

2. Description of the Related Art

This type of braille printer is well known as it is disclosed in Japanese Patent Laid-Open No. 56-98187. In this type of braille printer, a matrix, in which recesses are formed in the form of a line, is fixed in position and embossing rams whose top ends are projected are arranged facing the matrix. The embossing rams which are displaced in response to braille signals to positions where projections and recesses are pressed are driven from below towards the matrix by common block-shaped drive beams.

That is, all embossing rams which are controlled to be displaced line by line to pressing positions are simultaneously driven by drive beams. Therefore, drive energy of an amount equal to that in which a plurality of braille characters are embossed simultaneously is momentarily required.

SUMMARY OF THE INVENTION

The present invention has been accomplished in light of the above-described circumstances.

An object of the present invention is to provide a braille printer of the type described above in which a reduction of momentary power required to form one line of braille characters is made possible.

In the present invention, cams for moving embossing dies forward are placed at both sides of the lower section of the embossing die which is held in such a manner as to be movable forward or backward at printing positions. The contours of these cams at both sides thereof each have an apex, both apices being the same distance from the cam shaft. The apex of one of the cams is formed to be continuous over a predetermined rotational angle. The apex of the other cam is formed so as to have a phase difference relative to the starting point of the range of the predetermined rotational angle.

A peak energy required to form braille characters is reduced and averaged by a simple construction in which a embossing die is pressed by giving a time difference thereto in the direction of each of the lines by cams out of phase with the die. As a result, a drive source and related drive mechanisms are simplified and thus advantageous in terms of cost.

The aforementioned and other objects, features and advantages of the present invention will become clear when reference is made to the following description of the preferred embodiments of the present invention, together with reference to the accompanying drawings.

DETAILED DESCRIPTION OF THE PREFERRED EMBODIMENTS

FIGS. 1 to 4 show a braille printer according to an embodiment of the present invention.

Figure 1:
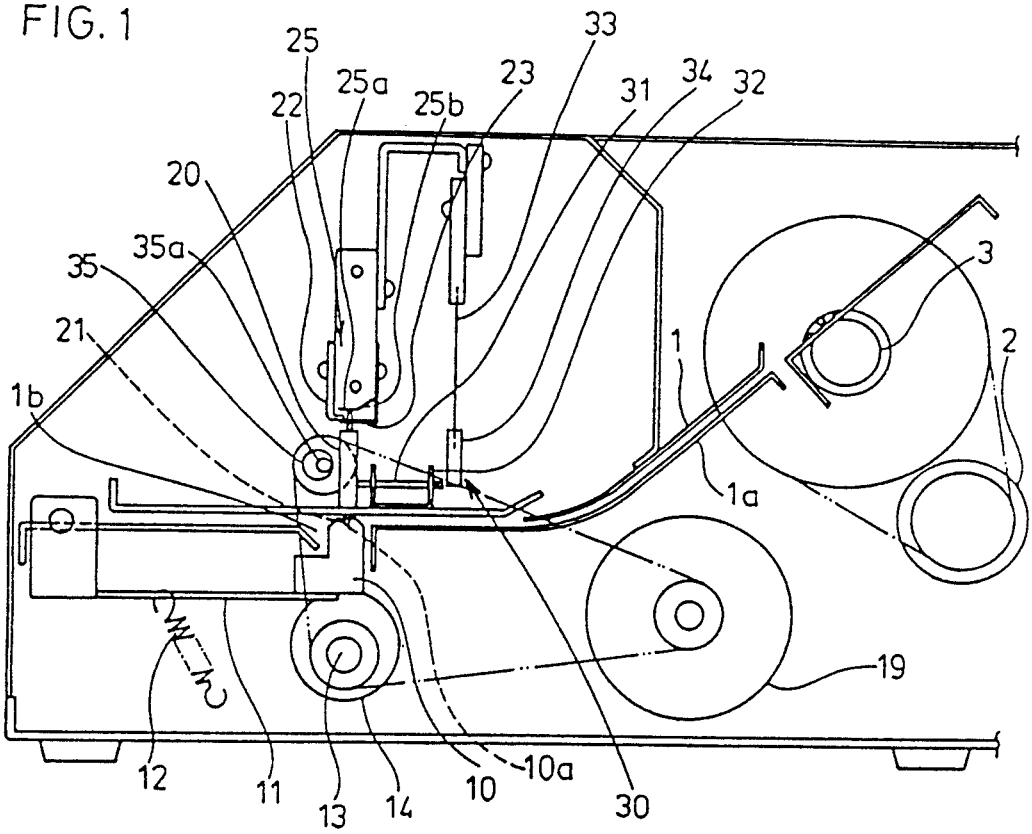
FIG. 1 is a side view which illustrates a braille printer according to an embodiment of the present invention.

In FIG. 1, paper (not shown), locked by a ratchet 3 which is rotated by a motor 2 between upper and lower paper guide plates 1 and 1*a* via a pulley, is fed successively in units of line pitches. An L-shaped block-like embossing die 10 on the top surface of which recesses 10*a* for forming one line of braille characters are arranged, is disposed in an opening 1*b* in the middle of a guide plate 1*a*. The embossing die 10 is held by substantially horizontal arms 11 which manifest a flexing property at both ends thereof in the direction of each of the lines. The embossing die 10 is energized downward by a spring 12. As a result, the embossing die 10 can move vertically and can be inclined in the direction of each of the lines.

Figure 2:
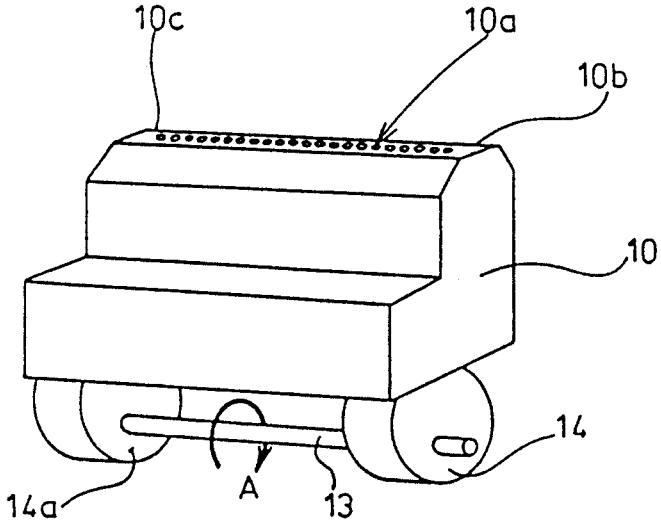
FIG. 2 is a perspective view which illustrates a embossing die of the printer.
Figure 3:
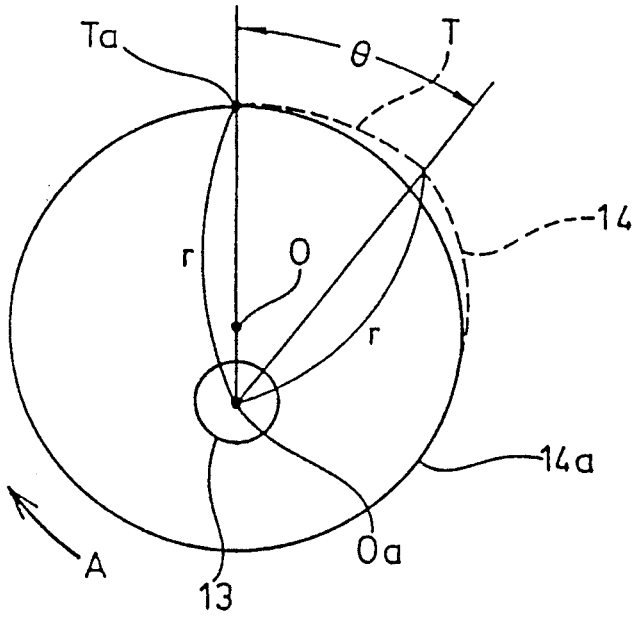
FIG. 3 is a side view which illustrates the construction of a cam for moving the embossing die.

As shown in FIG. 2, a cam shaft 13 whose both ends are pivoted is disposed below the embossing die 10. Cams 14 and 14*a* are fixed to both sides of the cam shaft 13. These cams, as shown in FIG. 3, are discs having basically the same diameter. They are made eccentric from a central point 0 to a same eccentric position 0*a* and fixed to the cam shaft 13. The distance from the eccentric position 0*a* to the apex is set at a distance r. An apex T of the cam 14 is continuous in the shape of an arc about 0*a* over a range of angle $\theta$, for example, 30°, and has a shape slightly deformed from a true circle. The cam 14*a* is a perfectly circular disc cam, and an apex Ta has a phase difference of an angle $\theta$ relative to the starting point of the apex T of the cam 14 and is positioned at the terminal point thereof. As a result, when the cam shaft 13 is rotated in the direction of the arrow A and the apex T of the cam 14 comes to a drive position perpendicularly above, the embossing die part 10*b* on the front side thereof seen in FIG. 1 or 2 is moved forward to a predetermined pressing position (state shown in FIG. 1) in opposition to the tensile force of the spring 12, and maintains its position while it is being further rotated an angle $\theta$. The inner part of the embossing die 10 is gradually moved forward as the apex Ta approaches. When the embossing-die part 10*b* is rotated the angle $\theta$ and reaches the drive position, the innermost embossing-die part 10*c* moves to the pressing position and the whole die moves to the pressing position. That is, embossing is gradually performed in the direction of the line between the angle $\theta$.

Figure 4:
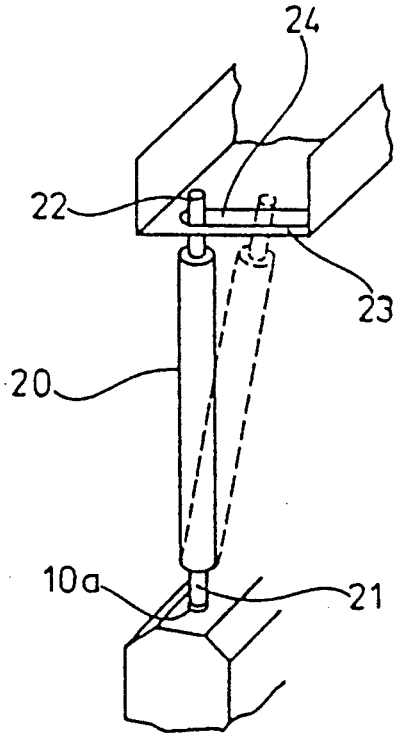
FIG. 4 is a perspective view which illustrates a debossing-die rod of the printer.

Reference numeral 20 denotes a debossing-die rod formed as a projection 21 having a spherical shape such that the top end thereof engages with each of the recesses 10*a* of the embossing die 10. As shown in FIG. 4, a pin 22 is formed in the upper end of the debossing-die rod 20, and is slidably inserted into an oblong hole 24 formed in a guide plate 23. A block-shaped stopper 25 is disposed above the guide plate 23. The height thereof, in an upper vertical position with respect to each of the recesses 10*a*, is set so that the backward movement of the pin 22 in a state in which the projection 21 is engaged with each of the recesses 10*a* is restricted. The continuation of an inclined surface 25*b* on the horizontal restriction surface 25*a* permits the pin 22 to move backward in a state in which the projection 21 is engaged with each of the recesses 10*a*, at the original position of the rod 20 indicated by the dotted line at which the debossing-die rod 20 is inclined, allowing the pin 22 to escape upward. Thus, pressing is not performed.

Reference numeral 30 denotes a plurality of rod driving mechanisms, which, in response to braille signals, cause a number of the debossing-die rods 20 arranged equal to the number of recesses 10*a* to be displaced from its oblique original position to the above-mentioned vertical position indicated by the solid line. Each of these mechanisms comprises a pressing bar 31 which is slidably guided by a guide plate 32 so as to press each of the debossing-die rods 20, a piezoelectric actuator 33 which, in response to the braille signals, flexes in the direction of the debossing-die rods 20, and a pressing plate 34, mounted on the top end of the piezoelectric actuator 33, which is brought into abutment with the pressing bar 31. Reference numeral 35 denotes a cam, fixed to a cam shaft 35*a*, for displacing each of the debossing-die rods 20, which have been respectively moved forward to the original position indicated by the dotted line in FIG. 4, together with the pressing bar 31. The cam shaft 35*a*, together with the cam shaft 13, is driven by a common motor 19 via an attached pulley. The above sections 19, 30 to 35, and 35*a* constitute the debossing-die controlling mechanism of the present invention. The rotational positions of the apices of cams 14, 14*a* and 35 are set so that timing can be obtained at which each of the debossing dies 20 are made to return to its original position after each of the debossing-die rods 20, which have been moved to the pressing position, are pressed against the embossing die 10.

The operation of a braille printer constructed as described above will now be explained.

The piezoelectric actuators 33 at positions corresponding to braille signals are operated each time paper is fed every line spacing, and the pressing bar 31 is moved forward, causing the related debossing-die rod 20 to be displaced from its original position indicated by the dotted line to the position indicated by the solid line in FIG. 4. As the motor 19 is rotated in synchronization with the braille signals, the cam 14 is rotated to the drive position and later the cam 14*a* is rotated thereto. The embossing die 10 is gradually moved forward from the front section to the inner section of the braille printer seen in FIG. 1, and this forward movement is terminated when the embossing die 10 is rotated an angle $\theta$. Each of the projections 21 of each of the debossing-die rods 20 which has been displaced vertically during this forward movement is engaged with the corresponding recess 10*a*, and the upper end thereof is restricted by the stopper 25. Thus, they are pressed against each other, with paper being provided therebetween, and braille characters are formed. The cam 35, which is rotated during this time period, causes the debossing-die rod 20 to move to its original position at the timing when the embossing die 10 is moved backward from the embossing position. Pressing is performed in sequence rather than simultaneously, with the result that the amount of a momentary driving force of the motor 19 required to form braille characters is reduced considerably. As a result, one line of braille characters is produced, and paper feeding is performed according to one dot spacing and one character spacing. Then, the operations similar to those described above are repeated.

While a preferred form of the invention has been described, obviously various modifications and variations are possible in light of the above teachings. It is therefore to be understood that within the scope of the appended claims, the invention may be practiced otherwise than as specifically described, for example, projections can be formed on a embossing die, recesses formed on a debossing die, or another system employed for a debossing-die controlling mechanism.

What is claimed is:

1. A braille printer, comprising:

an embossing die having a bottom surface, means mounting said embossing die for movement from an original position to an embossing position and being selectively inclined in the direction of a line of braille characters;

a plurality of debossing dies disposed independently of each other, a plurality of recesses being formed in either one of said embossing die or said plurality of debossing dies, and a plurality of projections being formed in the other one, and said projections and said recesses having a complementary shape for engaging with each other in response to braille signals;

debossing-die control means for displacing said debossing dies in response to braille signals each time one line of braille characters is embossed, said debossing-die control means further including means for moving each of the debossing dies from their original position to an embossing position where each of the debossing dies are pressed against the embossing die;

a first cam and a second cam brought into abutment with said bottom surface of said embossing die so as to make the embossing die move into said embossing position, a cam shaft positioned below the embossing die, the cams having contours and being fixed at both ends of said cam shaft, the contours of the cams each having an apex positioned a substantially equal distance from the cam shaft, the apex of said first cam being formed to be continuous over a predetermined rotational angle, and the apex of said second cam being formed so as to have a phase difference relative to the predetermined rotational angle of the first cam, wherein rotating said cam shaft presses the embossing die against the debossing dies in the embossing position in sequence resulting in a reduced momentary driving force required for rotating said cams to form a line of braille characters.

2. A braille printer according to claim 1, wherein said first and second cams are discs having a substantially equal diameter and are fixed to the cam shaft, said cams are eccentric from a central point of each disc to a corresponding eccentric position; the apex of said first cam is deformed slightly from the disc as an arc from a starting point to a terminal point about the eccentric position over a predetermined rotational angle; the apex of the second cam being positioned at the terminal point of the first cam.

3. A braille printer according to claim 1, wherein the embossing die is held by a flexible arm capable of flexing in the direction of a line of braille characters to be printed wherein the line of braille characters are embossed in sequence.

* * * * *